US006257538B1

(12) United States Patent
Pangborn et al.

(10) Patent No.: US 6,257,538 B1
(45) Date of Patent: Jul. 10, 2001

(54) KEYBOARD MOUNTING MECHANISM

(75) Inventors: Donald R. Pangborn, Jamestown; Peter J. Kerl, Angola, both of NY (US)

(73) Assignee: Weber Knapp Company, Jamestown, NY (US)

( * ) Notice: Subject to any disclaimer, the term of this patent is extended or adjusted under 35 U.S.C. 154(b) by 0 days.

(21) Appl. No.: 09/180,786

(22) PCT Filed: Nov. 13, 1998

(86) PCT No.: PCT/US98/23246

§ 371 Date: Nov. 16, 1998

§ 102(e) Date: Nov. 16, 1998

(87) PCT Pub. No.: WO00/29695

PCT Pub. Date: May 25, 2000

(51) Int. Cl.[7] ..... E04G 3/00
(52) U.S. Cl. ..... 248/284.1; 248/291.1
(58) Field of Search ..... 248/284.1, 291.1, 248/918

(56) References Cited

U.S. PATENT DOCUMENTS

| | | | | |
|---|---|---|---|---|
| 4,616,798 | | 10/1986 | Smeenge et al. | 248/281.1 |
| 4,644,875 | | 2/1987 | Watt | 108/93 |
| 4,691,888 | | 9/1987 | Cotterill | 248/284 |
| 5,037,054 | | 8/1991 | McConnell | 248/284 |
| 5,513,579 | * | 5/1996 | Allan | 248/918 X |
| 5,791,263 | | 8/1998 | Watt et al. | 108/138 |
| 5,836,560 | * | 11/1998 | Kaplan et al. | 248/284.1 X |
| 5,839,373 | * | 11/1998 | Lin | 248/918 X |
| 5,924,664 | * | 7/1999 | Mileos et al. | 248/284.1 X |

* cited by examiner

*Primary Examiner*—Leslie A. Braun
*Assistant Examiner*—A. Joseph Wujciak
(74) *Attorney, Agent, or Firm*—Simpson, Simpson & Snyder, L.L.P.

(57) ABSTRACT

A mechanism for mounting a keyboard supporting surface on a base including a linkage for mounting the surface for vertical swinging movement relative to the base and for vertical tilting movement relative thereto, a lock device for simultaneously locking the surface against swinging and tilting movements, a counterbalance spring for opposing downwardly directed swinging movement of said surface and a return spring for opposing downwardly directed tilting movement of said surface.

3 Claims, 2 Drawing Sheets

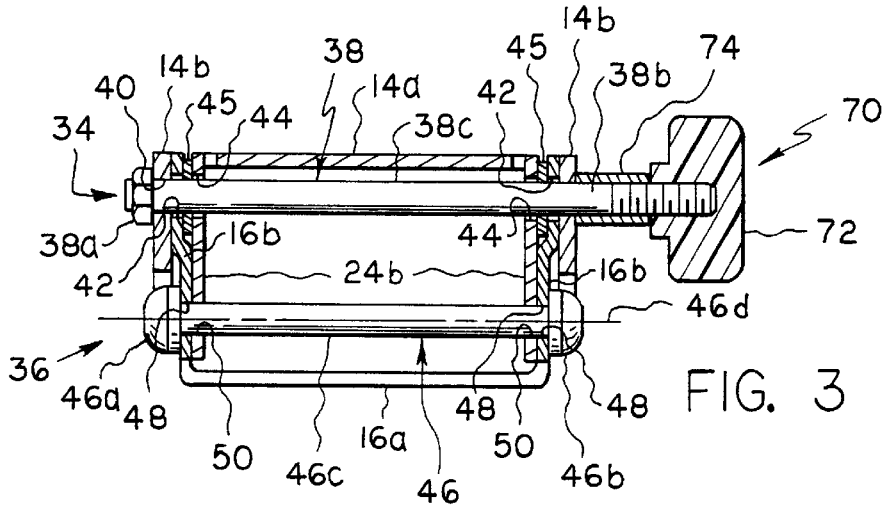
FIG. 3
FIG. 4
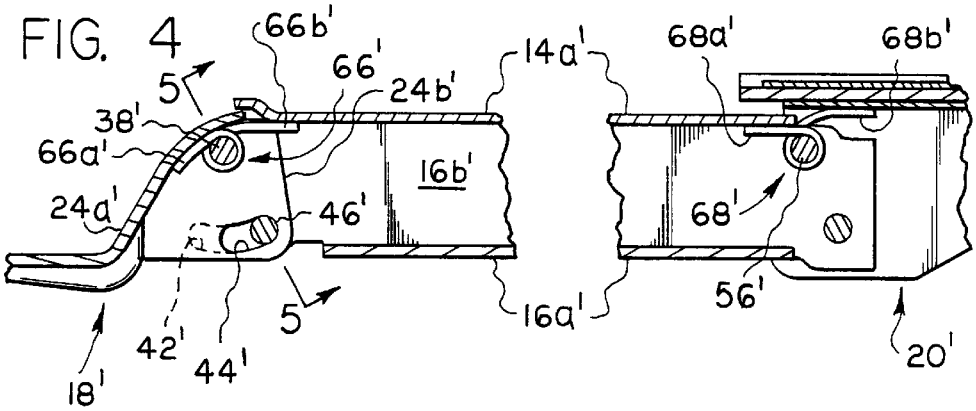
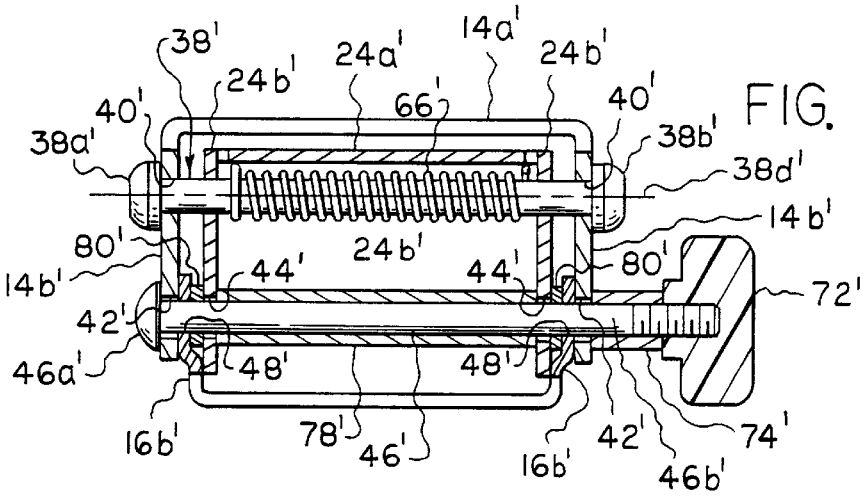
FIG. 5

KEYBOARD MOUNTING MECHANISM

This application claims the benefit of PCT International Application Ser. No. PCT/US98/23246, filed Nov. 13, 1998.

BACKGROUND OF THE INVENTION

It is known to support a surface, such as may be defined by a keyboard supporting tray, for vertically swinging movement relative to a base, such as may be defined by the top of a table or work station, by a mechanism including a pair of link elements each having first and second ends thereof pivotally connected to a surface mounting element and a base mounting element, respectively. Such mechanisms typically include a counterbalance spring tending to bias the surface mounting element and link elements upwardly relative to the base, and a manually operable locking mechanism serving to releasably retain the surface mounting element in a desired vertical position.

It has also been proposed to provide an additional bracket serving to interconnect the surface mounting element to the link elements in a manner allowing downwardly directed tilting movement of the surface mounting element in combination with an additional manually operable locking mechanism serving to releasably retain the surface mounting element in a desired tilted position.

Known clamping mechanisms are disclosed for example by U.S. Pat. Nos. 4,616,798; 4,644,875; 4,691,888; 5,037,054 and 5,791,263.

SUMMARY OF THE INVENTION

The present invention relates to improvements in mechanisms for mounting a keyboard supporting surface for both vertical swinging movement relative to a base and for vertical tilting movements under the control of a single or common locking mechanism, wherein a spring bias is provided for opposing both vertically downwardly directed swinging and tilting movements of the keyboard supporting surface.

In the preferred construction of the present mechanism, separate counterbalance and return or tilt control springs are provided in order to permit individually controlled swinging and tilting movements of the keyboard supporting surface.

BRIEF DESCRIPTION OF THE DRAWINGS

The nature and mode of operation of the present invention will now be more fully described in the following detailed description taken with the accompanying drawings wherein:

FIG. 3 is a sectional view taken generally along the line 3—3 in FIG. 1;

FIG. 4 is a fragmentary sectional view similar to FIG. 2, but showing alternative form of the present invention; and FIG. 5 is a sectional view similar to FIG. 3, but showing the alternative form of the present invention.

DETAILED DESCRIPTION

Figure 1:
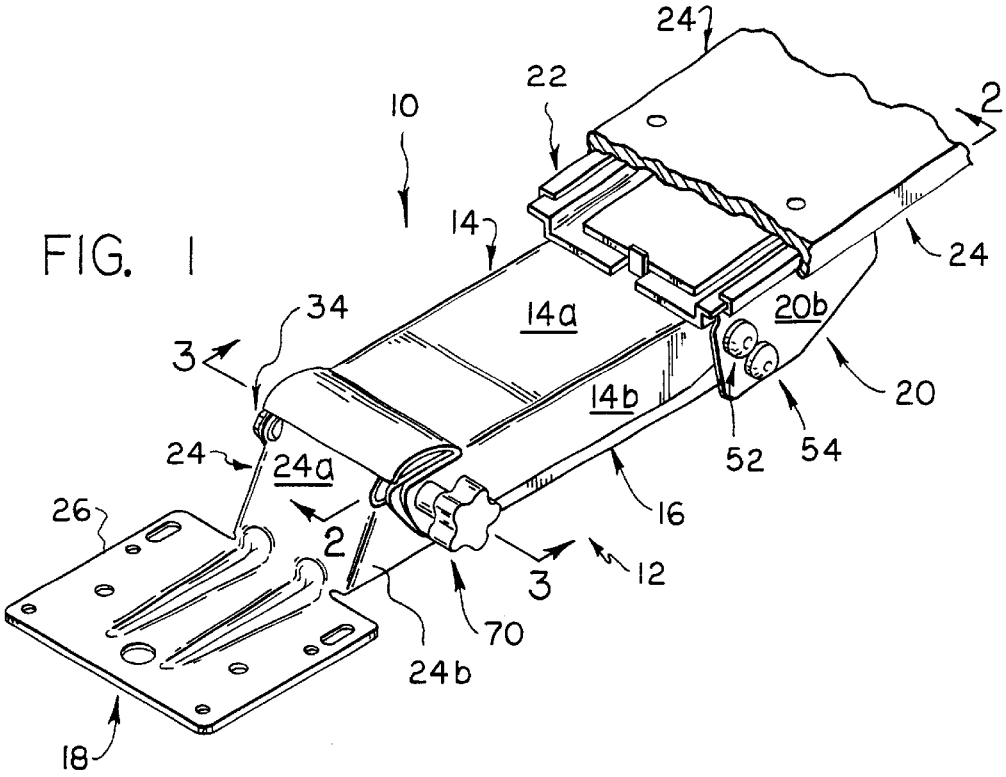
FIG. 1 is a prospective view of a keyboard mounting mechanism incorporating the invention.

Reference is first made to FIG. 1, wherein a keyboard mounting mechanism formed in accordance with the present invention is designated as 10, and shown as generally including a linkage 12 comprising first or upper and second or lower link elements 14 and 16 having first or front ends pivotally connected to a first element 18, which is adapted for mounting a keyboard supporting surface, not shown, and second or rear ends pivotally connected to a second element 20, which is adapted for mounting on a suitable base, such as may be defined by the top of a table or work station, not shown, either directly or via a guide plate 22 slidably received within a guide track 24. Link elements 14 and 16, and first and second elements 18 and 20 cooperate to define a four-bar linkage, which is preferably a parallelogram linkage.

Figure 2:
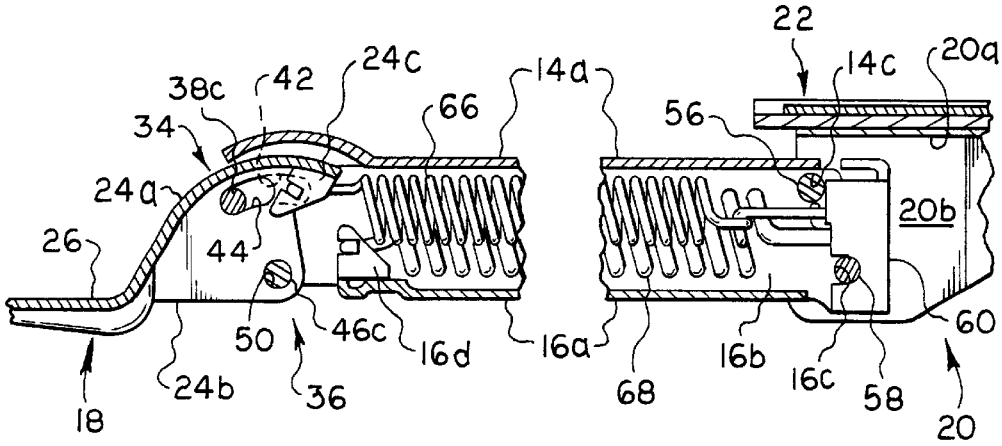
FIG. 2 is a fragmentary sectional view taken generally along the line 2—2 in FIG. 1.

Link elements 14 and 16 are best shown in FIGS. 1, 2 and 3 as being of generally U-shaped configuration having upper and lower bridging panels 14*a* and 16*a*, respectively, and parallel and vertically extending side panels 14*b*,14*b* and 16*b*,16*b*, respectively, wherein the inwardly facing surfaces of side panels 14*b*,14*b* are parallel to and closely adjacent the outwardly facing surfaces of side panels 16*b*,16*b*.

First element 18 is shown as comprising an inverted generally U-shaped mounting portion 24 having a bridging panel 24*a* and a pair of parallel side panels 24*b*,24*b* arranged with their oppositely facing or outer surfaces disposed in a closely-spaced and parallel relationship to the facing or inner surfaces of side panels 16*b* and 16*b*. Bridging panel 24*a* is also formed integrally with a mounting plate 26 adapted for mounting a keyboard supporting tray or other suitable work surface, not shown.

Second element 20 is shown as having an inverted, generally U-shaped configuration defined by a bridging panel 20*a* and a pair of parallel side panels 20*b*,20*b* arranged with their facing or inner surfaces disposed in a parallel relationship and relatively adjacent the oppositely or outwardly-facing surfaces of side panels 14*b* and 14*b*.

The first ends of link elements 14 and 16 are connected to first element 18 by first pivot means, shown as including a first or upper and a second or lower pivot devices 34 and 36. As best shown in FIG. 3, upper pivot device 34 includes a pivot pin 38 having an enlarged first end 38*a*, a threaded second end 38*b* and a mid-portion 38*c* arranged to extend through bore openings 40,40 formed in side panels 14*b*,14*b*; arculate slots 42,42, formed in side panels 16*b*,16*b*; and arculate slots 44,44 formed in side panels 24*b*,24*b*. Spacer washers 45,45 are arranged concentrically of pivot pin intermediate side walls 16*b*,24*b* and 16*b*,24*b*.

Lower pivot device 36 includes a pivot pin 46 having enlarged first and second ends 46*a* and 46*b*, and a mid-portion 46*c* arranged to extend through bore openings 48,48 formed in side panels 16*b*,16*b* and bore openings 50,50 formed in side panels 24*b*,24*b*. Slots 42,42 and 44,44 are arranged equidistant from the center or pivot axis 46*d* of pivot pin 46.

Second ends of link elements 14 and 16 are connected to second element 20 by second pivot means including upper end and lower pivot devices 52 and 54, which include pivot pins 56 and 58 whose ends are received within pairs of aligned upper and lower bore openings, not shown, formed in side panels 20*b*,20*b*, and aligned pairs of bore openings provided in side panels 14*b* and 16*b*, only one of each of such pairs of bore openings being shown in FIG. 2 as 14*c* and 16*c*. Pivot pins 56 and 58 are parallel to each other and pivot pins 38 and 46.

A spring mounting bracket 60 is shown in FIG. 2 as being arranged within second element 20 and disposed to bear against pivot pins 56 and 58. Spring mounting bracket 60 is suitably connected to the rear ends of return or tilt control and counterbalance springs 66 and 68, whose forward ends are connected to bracket tabs 24*c* and 16*d*, formed internally with a rearwardly disposed edge of panel 24*a* of first element 18 and a forwardly disposed edge of panel 16*a* of lower link 16, respectively.

Return spring 66 tends to bias first element 18 for upwardly directed tilting movement in a direction extending clockwise of lower pivot pin axis 46*d* into an uppermost tilt position defined for instance by engagement of pivot pin 38 with the left hand end of slot 44, as shown in FIG. 2. When the clamping mechanism of the present invention designated generally as 70 in FIGS. 1 and 3 is in its release position to be described, first element 18 may be swung counterclockwise against the bias of return spring 66 about lower pivot pin 46 until it assumes a lower tilted position, not shown, defined for instance by engagement of pivot pin 38 with the right hand end of slot 44, as will become apparent from viewing FIG. 2.

Counterbalance spring 68 tends to bias first element 18 to swing upwardly relative to second element 20 from a suitably lower storage position, not shown, through intermediate use positions, only one of which is shown in FIGS. 1 and 2, into a suitably defined upper use position, also not shown. When clamping mechanism 70 is in its clamping position to be described, first element 18 is clamped against tilting or pivotal movement about pivot pin 46 and again vertical swinging movements relative to second element 20. When the clamping mechanism is in its release position, return spring 66 cooperates with counterbalance spring 68 to bias the first element for vertical movement relative to the second element.

The clamping mechanism employed in the practice of the present invention may be variously defined, but may in its simplest form include a manually operable knob 72 threaded onto upper pivot pin threaded end portion 38*b* for engagement with a sleeve 74 arranged to end abut against an outer surface of one of side panels 14*b*;14*b*. Tightening knob 72 simultaneously serves to clamp side panels 14*b*;14*b*; side panels 16*b*,16*b* and side panels 24*b*,24*b* between sleeve 74 and pivot pin enlarged end 38*a*, and thereby prevent tilting movement of element 18 about pivot pin 46 and relative movement between link elements 14 and 16. Conversely, the slight unthreading of knob 72 simultaneously releases element 18 for tilting and vertical swinging movements.

An alternate construction is shown in FIGS. 4 and 5, wherein element 18' is shown as being supported for tilting movement about pivot axis 38*d'* of upper pivot pin 38', and slots 42', and 44' arranged to receive lower pivot pin 46' with slot 44' cooperating with lower pivot pin 46' to define the limits of tilting movement of element 18'. More specifically, side walls 14*b'*,14*b*, of upper link 14' have aligned bore openings 40',40' for receiving pivot pin 38' and slots 42' and 42'; and the side walls 16*b'* and 16*b'* of lower link 16 have aligned bore openings 48',48' to receive lower pivot pin 46'. Further, upper pivot pin 38' is provided with enlarged ends 38*a'*,38*b'*; lower pivot pin 46' is provided with an enlarged first end 46*a'* and a threaded second end 46*b'* for receiving a clamping sleeve 74' and a manually operable knob 72'; a spacer sleeve 78' is disposed concentrically of pivot pin 46' in order to prevent converging movement of side walls 24*b'* when the knob is tightened; and spacer washers 80',80' are disposed concentrically of pivot pin 46' intermediate side walls 16*b'*,24*b'* and 16*b'*,24*b'*.

FIG. 4 further illustrates a modified return spring arrangement, wherein a coil-type torsion spring 66' is disposed concentrically of pivot pin 38' with its opposite ends 66*a'* and 66*b'* arranged to bear against the downwardly facing surfaces of bridging panels 24*a'* and 14*a'*. Further, in FIG. 4, a modified counterbalance spring arrangement is shown, wherein a coil-type torsion spring 68' is disposed concentrically of pivot pin 56' with its opposite ends 68*a* and 68*b* arranged to bear on the downwardly facing surfaces of bridging panels 14*a'* and 20*a'*, respectively.

As with the first embodiment of the invention shown in FIGS. 1–3, the alternative embodiment employs return spring 66' to bias first element 18' for clockwise directed movement relative upper link 14 and counterbalance spring 68' to bias the upper link for clockwise directed swinging movement relative to second element 20'.

It is contemplated that various combinations of tension and torsion springs may be employed and, if desired, one or both such springs replaced by other known spring devices, such as gas operated springs. Still further, it is contemplated that a single spring extending for example between bracket 60 and tab 24*c* may be employed to perform both return and counterbalance functions, although separate springs are preferred.

What is claimed is:

1. A mechanism for mounting a keyboard supporting surface for movement relative to a base comprising:

first and second link elements each having a first and a second end;

first and second elements adapted to be connected to said surface and said base, respectively;

first and second pivot means for movably connecting said first and second ends of said first and second link elements to said first and second elements, respectively, to permit vertical swinging movement of said first element relative to said second element, said first pivot means including first and second pivot devices, said first pivot device extends through a bore opening in said first end of one of said first and second link elements and an arculate slot formed in said first end of the other of said first and second link elements and said first element, said second pivot device extends through bore openings in said first end of said other of said first and second link elements and said first element; said first and second pivot devices have parallel pivot axes and said slots have like radii of curvature measured from a pivot axis of said second pivot device;

spring means for opposing downwardly directed vertical swinging movement of said first element relative to said second element and downwardly directed tilting movement of said first element about said second pivot device, said spring means includes tilt and counterbalance springs, said tilt spring being connected between said second element and said first element for creating a bias tending to tilt said first element upwardly about said second pivot device and said counterbalance spring being connected between said second element and said first end of said second link element for creating a bias tending to swing said first element upwardly relative to said second element; and clamping means associated with said first pivot device for simultaneously opposing said vertical swinging movement of said first element relative to said second element and said tilting movement of said first element about said second pivot device.

2. A mechanism according to claim 1, wherein said second pivot means includes a pair of pivot pins connecting said second ends of said first and second link elements to said second element, and a spring mounting bracket is provided for connecting both of said springs to said second element.

3. A mechanism for mounting a keyboard supporting surface for movement relative to a base comprising:

upper and lower link elements each having a first and a second end, first and second elements adapted to be connected to said surface and said base, respectively;

first and second pivot means for movably connecting said first and second ends of said upper and lower link elements to said first and second elements, respectively, to permit vertical swinging movement of said surface relative to said base, said first pivot means including upper and lower pivot pins, said upper pivot pin extends through a bore opening in said first end of said upper link element and arculate slots formed in said first end of said lower link element and said first element, said lower pivot pin extends through bore openings in said first end of said lower link element and said first element; said upper and lower pivot pins have parallel pivot axes and said slots having like radii of curvature measured from a pivot axis of said second pivot pin;

spring means for opposing downwardly directed vertical swinging movement of said first element relative to said second element and downwardly directed tilting movement of said first element about said lower pivot pin, said spring means includes tilt and counterbalance tension springs arranged to extend lengthwise of said upper link element, said springs each having first and second ends, said second pivot means includes a pair of pivot pins for pivotally connecting said second ends of said upper and lower link elements to said second element, and a spring mounting bracket is arranged to bear on said pair of pivot pins for connecting said second ends of said springs to said second element, said first end of said tilt spring being connected to first element, and said first end of said counterbalance spring being connected to said first end of said lower link element, and clamping means associated with said upper pivot pin for simultaneously opposing vertical swinging movement of said first element relative to said second element and tilting movement of said first element about said second pivot pin.

* * * * *